US007796027B1

(12) United States Patent
Daniel

(10) Patent No.: US 7,796,027 B1
(45) Date of Patent: Sep. 14, 2010

(54) SYSTEM FOR PROVIDING LOCATION BASED HUMAN LOGISTICS

(76) Inventor: Sayo Isaac Daniel, 848 Brickell Key Dr., #3402, Miami, FL (US) 33131

( * ) Notice: Subject to any disclaimer, the term of this patent is extended or adjusted under 35 U.S.C. 154(b) by 338 days.

(21) Appl. No.: 11/849,902

(22) Filed: Sep. 4, 2007

Related U.S. Application Data

(63) Continuation-in-part of application No. 10/979,894, filed on Nov. 1, 2004, now Pat. No. 7,265,666, and a continuation-in-part of application No. 11/560,762, filed on Nov. 16, 2006, now abandoned, and a continuation-in-part of application No. 11/619,189, filed on Jan. 2, 2007, and a continuation-in-part of application No. 11/626,356, filed on Jan. 23, 2007.

(51) Int. Cl.
*G08B 1/08* (2006.01)

(52) U.S. Cl. ..... 340/539.13; 340/539.1; 340/539.11; 340/539.2

(58) Field of Classification Search ..... 340/539.1, 340/539.11, 539.13, 539.2, 539.24, 539.21, 340/539.22
See application file for complete search history.

(56) References Cited

U.S. PATENT DOCUMENTS 3,750,023 A * 7/1973 Weissenborn et al. ..... 455/100
4,491,971 A * 1/1985 Webb et al. ..... 455/100
4,495,495 A * 1/1985 Ormanns et al. ..... 340/7.61
4,495,496 A * 1/1985 Miller, III ..... 340/10.2
4,747,120 A * 5/1988 Foley ..... 379/38
5,438,321 A * 8/1995 Bernard et al. ..... 340/573.4
5,635,907 A * 6/1997 Bernard et al. ..... 340/573.4
5,995,017 A * 11/1999 Marsh et al. ..... 340/10.2
6,339,709 B1 * 1/2002 Gladwin et al. ..... 455/115.1
6,788,200 B1 * 9/2004 Jamel et al. ..... 340/539.13
7,005,980 B1 * 2/2006 Schmidt et al. ..... 340/539.13
7,265,666 B2 * 9/2007 Daniel ..... 340/539.11
7,511,625 B2 * 3/2009 Mardirossian ..... 340/573.1
2004/0021569 A1 * 2/2004 Lepkofker et al. ..... 340/568.1
2008/0137589 A1 * 6/2008 Barrett ..... 370/327
2009/0140852 A1 * 6/2009 Stolarczyk et al. ..... 340/539.13

* cited by examiner

*Primary Examiner*—Travis R Hunnings
(74) *Attorney, Agent, or Firm*—Sanford J. Asman

(57) ABSTRACT

Articles of footwear, such as shoes, are worn by personnel whose movements are the subject of a location based human logistics study. The articles of footwear each contain a location determining apparatus, such as a GPS receiver, and a communications module, such as a cellular phone module. The articles of footwear each report their respective locations to a central monitoring station. However, each wearer of each article of footwear has the ability to "opt out" of the monitoring and tracking process whereby his privacy is maintained after work and during breaks. On the other hand management reports can be generated based on triggering events and based upon personnel who have chosen to "opt out" of the monitoring and tracking for extended periods of time.

2 Claims, 1 Drawing Sheet

SYSTEM FOR PROVIDING LOCATION BASED HUMAN LOGISTICS

CROSS-REFERENCE TO RELATED APPLICATIONS

The present application is a continuation-in-part of U.S. patent application Ser. No. 10/979,894 entitled FOOTWEAR COVERT ALARM AND LOCATOR APPARATUS filed by Sayo Isaac Daniel on Nov. 1, 2004, to be issued as U.S. Pat. No. 7,265,666 on Sep. 4, 2007; Ser. No. 11/560,762, entitled HAND WORN ATTIRE WITH BUILT-IN GPS RECEIVER, filed Nov. 16, 2006; Ser. No. 11/619,189 entitled FOOTWEAR WITH INTEGRATED VIDEO GAMING APPARATUS, filed Jan. 2, 2007; and Ser. No. 11/626,356 entitled BACKPACK HAVING A COVERT ALARM AND LOCATOR APPARATUS, filed Jan. 23, 2007, all by the present inventor, the priority of all of which are claimed, and the contents of all of which are hereby incorporated by reference.

BACKGROUND OF THE INVENTION

The present invention relates to a system for studying personnel movement for management applications. In particular, the present invention relates to a system for location based study of personnel movement using an article of footwear equipped with means for determining and selectively reporting the position of the footwear (and, therefore, the position of the personnel wearing the footwear) while maintaining the off-the-job privacy of the personnel whose on-the-job movements are the subject of location based human logistics study.

As used herein, "location based human logistics" is a term intended to relate to the reporting to management of the location of personnel whose job requires them to move throughout different geographical areas. By way of example, location based human logistics ("LBHL") can be used to perform studies relating to the walking routes of mailmen employed by the United States Postal Service. Similarly, it can be used to perform studies relating to the movement of personnel employed at an amusement park or the location of ski patrolmen at a ski area. LBHL can also be employed to study the use of different routes by those involved in sales, political campaigns, or other route related activities.

Problems which have heretofore existed with respect to conducting LBHL studies include the difficulty in accurately collecting data associated with the tracking of the location of a number of individuals over time, and the collating and reporting of the that data in a manner which is both timely and accurate. While methods, including GPS tracking, can be (and have been) used to track and monitor the movements of personnel, problems with GPS tracking systems involve the difficulty of associating a unit with a person who is not in a vehicle on which the GPS tracking equipment can be mounted. An additional difficulty is that individuals, particularly when they are not actively "on the job" resent having their movements monitored, particularly if the GPS equipment is located on articles which they are required to carry or wear.

By providing a method for solving the foregoing problems an effective and efficient approach for providing LBHL could provide an effective management tool.

SUMMARY OF THE INVENTION

In accordance with the present invention, a method for providing location based human logistics reports has been devised. Specifically, the personnel whose movements are to be the subject of a management study relating to their movements, as a basis for establishing and creating effective and efficient management procedures are each equipped with an article of footwear which is capable of determining its own position using a location determining apparatus, such as a GPS receiver. Each article of footwear also includes transmitting means for transmitting a signal which has been encoded with the location and identification of each individual who is being managed to a central monitoring station. In a preferred embodiment of the invention, the transmitting means is comprised of a cellular phone module.

The system of the present invention differs from those of the prior art in that it includes means, in the form of a switch, which allows the personnel whose movements are being monitored with a means for selectively interrupting the monitoring process, thereby preserving their privacy. Thus, a person equipped with the footwear used in conjunction with the present invention have the ability to manually turn off the footwear's position reporting circuitry whereby their privacy is maintained. Thus, at the end of the work day, or shift, or during breaks, the personnel who are the subject of the study, can effectively "opt out" whereby their movements are not tracked.

During the time that the personnel are tracked, however, their identification, and their position at any given time, are monitored and recorded, whereby such data can be reported to management.

Of course, the integrity and usefulness of the system would be lost if personnel, whose movements were the subject of the study, could simply turn off the equipment and "opt out" of the study, altogether. Accordingly, the invention includes the steps of maintaining a list containing the identity of each person who has turned off his location reporting equipment, the time and location where it was turned off, and the time and location at which it was reactivated, whereby abuses in the election to "opt out" can be monitored and reported.

DETAILED DESCRIPTION OF THE PREFERRED EMBODIMENTS

Figure 1:
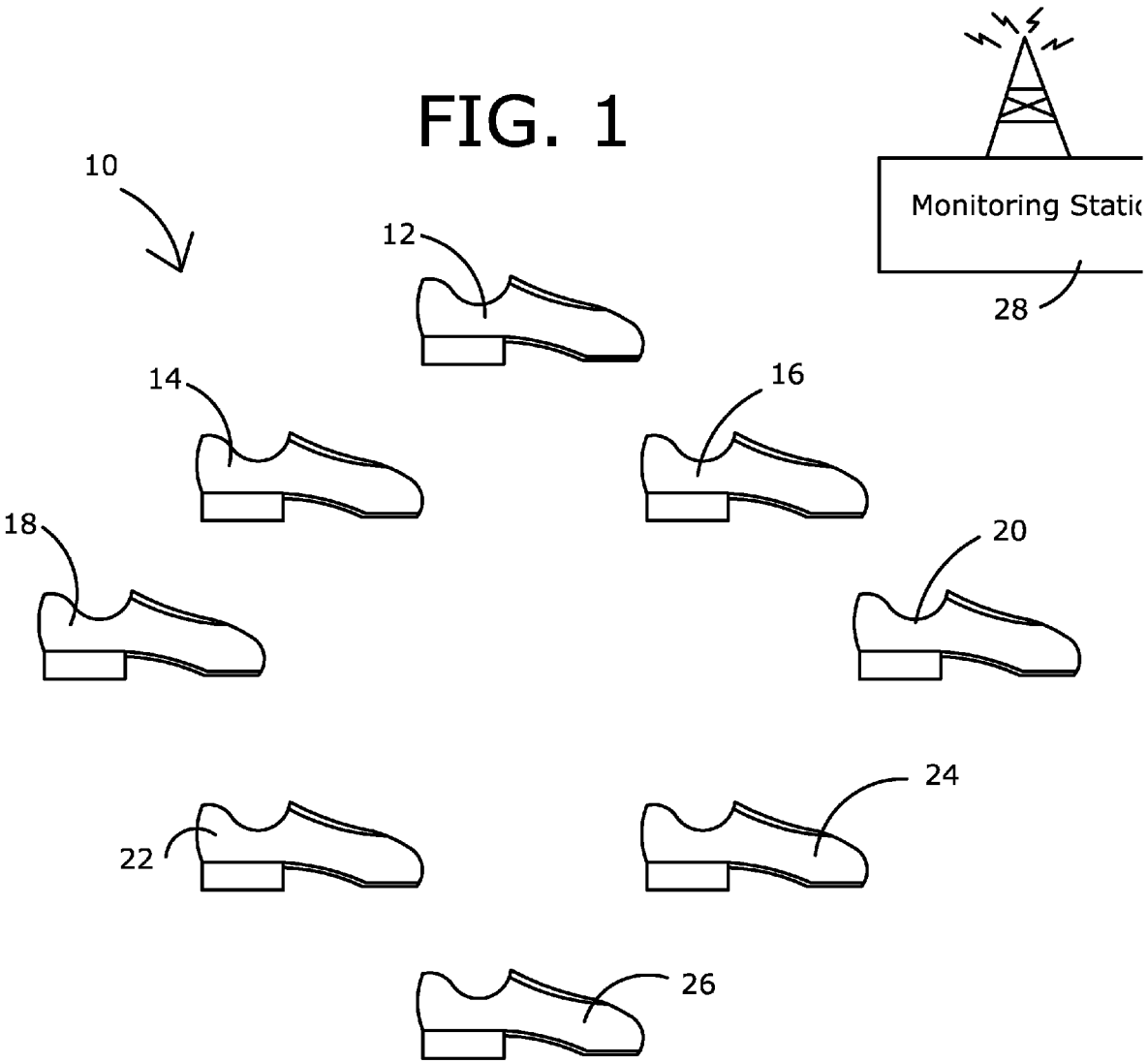
FIG. 1, the sole FIGURE of the drawing, is an overview of the system of the present invention.

With reference to FIG. 1, in accordance with the present invention a system for providing location based human logistics management information system 10 comprises a plurality of personnel (not shown), each of whom is wearing a piece of footwear 12, 14, 16, 18, 20, 22, 24, 26 which each include location determining means, such as a GPS receiver, along with means for reporting their respective positions to a central monitoring station 30. As explained in great detail in the parent application, the contents of which are incorporated herein by reference, the means for reporting the respective positions of the footwear to the monitoring station 30 is preferably comprised of a cell phone module located in each piece of footwear 12, 14, 16, 18, 20, 22, 24, 26.

In accordance with the preferred embodiment of the present invention, the absolute and relative locations of each piece of footwear 12, 14, 16, 18, 20, 22, 24, 26, and, consequently, each person who is the subject of the study, is reported to the central monitoring station 28. During normal operations, the location of each person who is the subject of the study is reported to the central monitoring station 28. In the preferred embodiment of the invention, the central monitoring station 28 will monitor and record both the absolute location of each piece of footwear as well as its relative position, and then, based on criteria uploaded to the central monitoring station 28, it will generate management reports which correlate the position of each person whose movement is being tracked with any other parameter, e.g., time, location, function, relation, etc., and it will issue a notification based on pre-defined scenarios. For example, in a study of the locations of amusement park personnel, a notification could be based on the repeated proximity of personnel whose jobs would not normally require them to maintain such proximity. Similarly, in the case of a ski resort, a notification could be generated by the lack of ski patrol personnel on a particular slope for a predetermined period of time.

Once the notification "triggers" have been established, it is a straightforward procedure to provide management with reports which show the results of the study based on the event notification criteria which management has established.

While the invention has been described in connection with specific embodiments and applications, the inventor does not intend to restrict the description to the examples shown. Persons skilled in the art will recognize that the above apparatus and methods may be modified or changed without departing from the general scope of the present description, the intention of the inventor being to include all such modifications and alterations in so far as they come within the scope of the appended claims or the equivalents thereof.

I claim:

1. A method for providing management reports through location based human logistics comprising:

(a) providing each of the personnel whose movements are to be reported with an article of footwear, said article of footwear including self-contained means for determining the location of said article of footwear, said means for determining the location of said article of footwear comprising a GPS receiver within said article of footwear, and for selectively reporting said location to a central monitoring station upon demand;

(b) providing a central monitoring station which monitors the location of each of the managed personnel;

(c) programming triggering events at said central monitoring station responsive to the location of each of said managed personnel, whereby data will be collected at said central monitoring station with respect to each of such triggering events;

(d) providing switch means comprising a switch on each said article of footwear whereby the individual wearing such footwear can selectively disable said means for determining the location of said article of footwear and/or said means for selectively reporting said location to a central monitoring station upon demand, whereby the individual wearing such footwear can disable its ability to report location data to said central monitoring station; and (e) providing management reports based on said triggering events which were programmed at said central monitoring station.

2. The method for providing for location based management of personnel of claim 1 further comprising the step of providing a management report listing each article of footwear which failed to report to said central monitoring station for a predetermined extended period, whereby personnel who have unilaterally opted out of the study can be identified.

* * * * *